US008172606B2

(12) United States Patent
Duval et al.

(10) Patent No.: US 8,172,606 B2
(45) Date of Patent: May 8, 2012

(54) ATTACHMENT DEVICE FOR A CONNECTOR

(75) Inventors: Frederic Duval, Aviron (FR); Laurent Houry, Le Roncenay-Authenay (FR); Alexis Synodinos, Courbevoie (FR)

(73) Assignee: Connecteurs Electriques Deutsch, Evreux (FR)

( * ) Notice: Subject to any disclaimer, the term of this patent is extended or adjusted under 35 U.S.C. 154(b) by 540 days.

(21) Appl. No.: 12/407,215

(22) Filed: Mar. 19, 2009

(65) Prior Publication Data

US 2009/0239415 A1 Sep. 24, 2009

(30) Foreign Application Priority Data

Mar. 19, 2008 (FR) ..... 08 01518

(51) Int. Cl.
*H01R 13/73* (2006.01)

(52) U.S. Cl. ..... 439/573

(58) Field of Classification Search ..... 439/571–573, 439/63

See application file for complete search history.

(56) References Cited

U.S. PATENT DOCUMENTS

| | | | | |
|---|---|---|---|---|
| 3,744,009 | A * | 7/1973 | Teagno et al. | 439/557 |
| 3,836,885 | A | 9/1974 | Larsile | |
| 4,209,217 | A * | 6/1980 | Gudaitis et al. | 439/372 |
| 5,530,297 | A * | 6/1996 | Rudy et al. | 307/104 |
| 6,065,982 | A * | 5/2000 | Okabe | 439/157 |
| 6,065,989 | A | 5/2000 | Walkup et al. | |
| 6,361,336 | B1 * | 3/2002 | Zhao et al. | 439/157 |
| 7,402,043 | B2 * | 7/2008 | Komiyama et al. | 439/34 |

FOREIGN PATENT DOCUMENTS

| | | |
|---|---|---|
| DE | 101 40 243 | 1/2003 |
| FR | 2 188 912 | 6/1972 |
| WO | 02/061893 | 8/2002 |

OTHER PUBLICATIONS

French Search Report, dated Sep. 17, 2008 and issued in corresponding French Patent Application No. 704676.

* cited by examiner

*Primary Examiner* — Briggitte R Hammond
(74) *Attorney, Agent, or Firm* — Young & Thompson

(57) ABSTRACT

An attachment device (1) for a connector, includes at least two clamps (2*a*, 2*b*, 3) that can attach the attachment device (1) in a removable manner to a panel (30), and a base (4) that delimits a housing (6) that can accommodate a connector (31) or a connector support (31), the attachment device (1) includes a bolt (5), whereby one of the clamps (3) is arranged on the bolt (5) and another of the clamps (2*a* or 2*b*) on the base (4), whereby the bolt (5) is able to pivot relative to the base (4) so as to bolt, via the clamp (3) of the bolt (5), the attachment device (1) to the panel (30), whereby the bolt (5) in addition is adjacent to the housing (6) such that when the connector (31) or the connector support (31) is in the housing (6), it prevents the bolt (5) from pivoting.

15 Claims, 3 Drawing Sheets

ATTACHMENT DEVICE FOR A CONNECTOR

This invention relates to an attachment device for a connector or a connector support and in particular an attachment device for a connector that no longer requires the use of specific tools or a system that is assembled with a spring.

This invention also has as its object a connector attachment support that comprises the above-mentioned attachment device.

In numerous fields, such as aeronautics and data-processing, the use of connectors is common, for example for connecting wire bundles or more generally two electronic devices. In a known way, an electrical connector comprises two parts: a first plug-in or base part and a second plug-in or jack part, able to be connected electrically.

For example, in the prior art, for attaching a base and a jack to a panel, it is necessary that the panel have a particular configuration. It should actually have an opening that has a generally approximately square shape or circular shape, capable of being able to work with one of the faces of the base that fits into said opening. For attaching the base of the connector, the panel comprises a ratchet or orifices that are intended to accommodate attachment means such as screws/washers/nuts. These orifices are arranged at the four corners of the opening.

Consequently, with such a system, the installation of connectors requires a preliminary panel cutting that also is complex. In addition, the connectors are often used en masse, i.e., a panel is intended in general to carry several connectors. Thus, with a device as described above, it becomes tedious to install connectors in narrow spaces.

In another embodiment that is known from the prior art, it may be that the panel has two or more orifices that are able to accommodate a connector that has three attachment points instead of one opening that is intended to accommodate one face of the base. At least one of said attachment points of the connector has a spring for attaching the connector more easily to the panel.

Consequently, in this embodiment, it is necessary to use special connectors.

This invention has as its object to propose a new attachment device for a connector, which prevents all or a portion of the above-mentioned drawbacks.

For this purpose, the invention has as its object an attachment device for a connector, comprising at least two clamps that can attach said attachment device in a removable manner to a panel, and a base that delimits a housing that can accommodate a connector, or a connector support, characterized in that said attachment device comprises a bolt, whereby one of the clamps is arranged on said bolt and another of the clamps on said base, whereby said bolt is able to pivot relative to the base so as to bolt, via the clamp of the bolt, said attachment device to said panel, whereby said bolt in addition is adjacent to the housing such that when the connector or the connector support is in the housing, it keeps the bolt from pivoting.

Thus, the attachment device according to this invention makes it possible to mount a connector or a connector support on a panel without specific tools and without an elastic system with a spring, while ensuring a mechanical locking of the latter. Such a system can therefore be easily installed in locations that are difficult to access or with limited spaces.

Preferably, the base comprises a first wall that comprises a cavity for housing the bolt, and a second wall that comprises an opening that makes it possible to insert the connector or the connector support into said housing.

Advantageously, the first wall is intended to be arranged parallel to the panel, whereby said second wall is perpendicular to the first wall, such that the connector or the connector support is inserted into the housing that is parallel to the panel.

According to a characteristic of the invention, said first wall comprises two clamps on its face that is intended to be in contact with said panel.

Preferably, the bolt comprises a foot that is able to work with a flange of the opening so as to form an attachment clip for the connector or the connector support.

Advantageously, said base and/or said bolt is/are molded in a single operation.

This invention also has as its object a connector attachment support that comprises an attachment device as described above and a panel that is pierced by at least two holes, whereby said attachment device is attached to the panel by its attachment means that are inserted into the holes of the panel.

The invention will be better understood, and other objects, details, characteristics and advantages of the latter will emerge more clearly during the following description of a particular embodiment of the invention, given only by way of illustrative and non-limiting example, with reference to the accompanying drawings.

Figure 1:
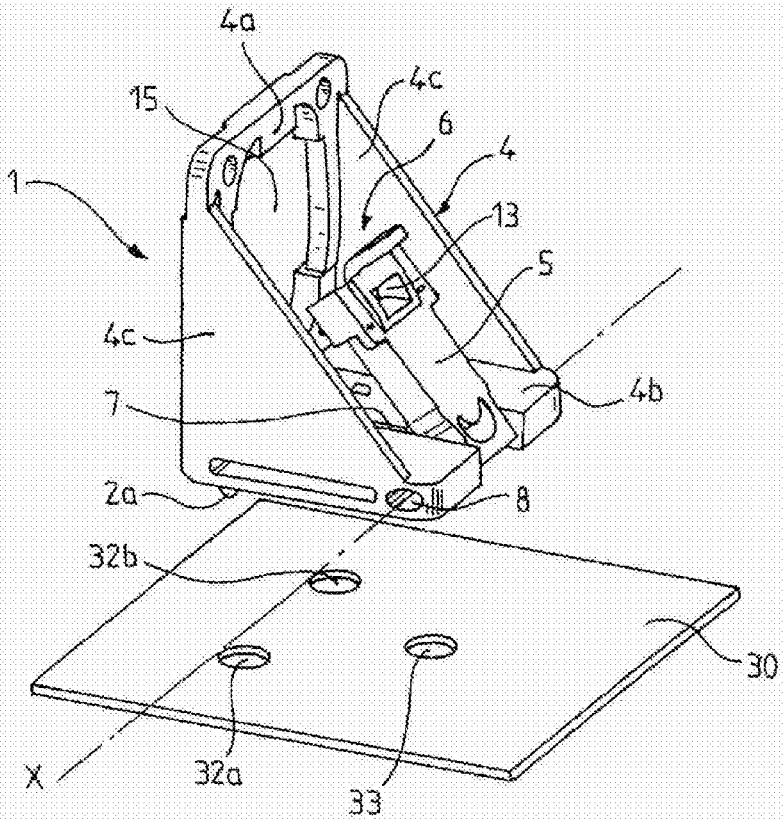
FIG. 1 shows a perspective view of the attachment device for a connector according to an embodiment of this invention.
Figure 6:
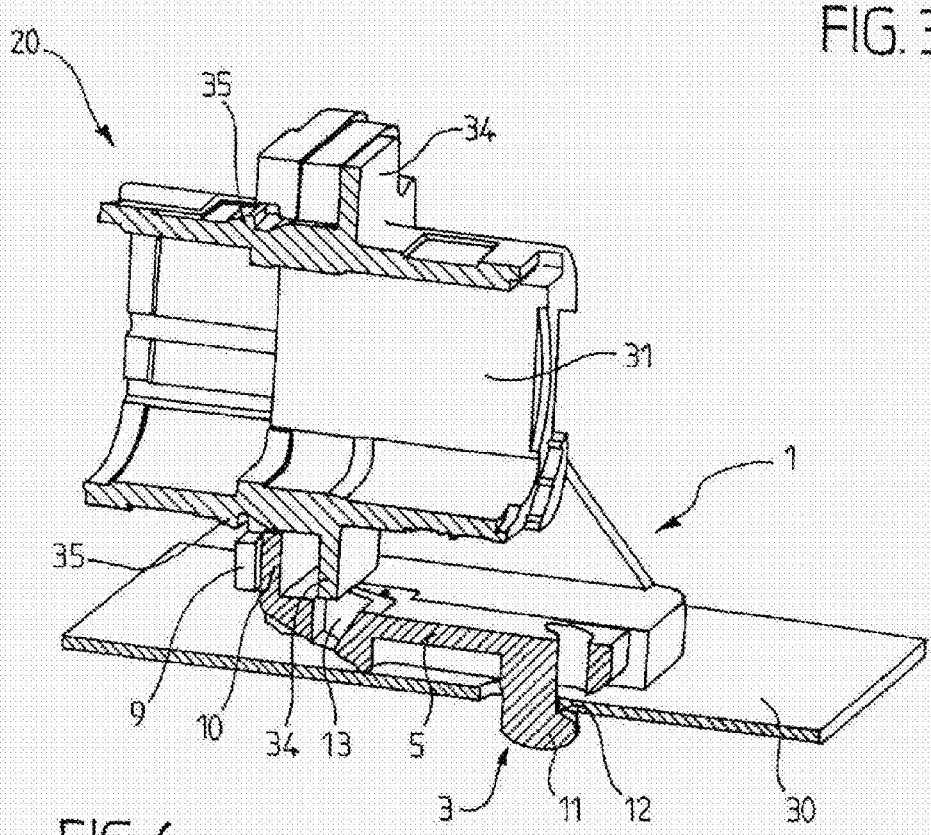

and FIG. 6 shows a partial perspective view of the device of FIG. 1 when the latter is locked by a connector.

According to the embodiment shown in FIG. 1, the attachment device 1 comprises a base 4 that consists of two approximately square-shaped walls 4*a* and 4*b*, whereby the wall 4*a* is perpendicular to the wall 4*b* such that the two walls 4*a* and 4*b* together form a right-angle dihedron. These two walls are connected at the level of their two adjacent sides by two panels 4*c*. The space between the walls 4*a*, 4*b* and the panels 4*c* of the base 4 delimits a housing 6 that is intended to accommodate a connector or a connector support 31 (FIG. 6).

Figure 2:
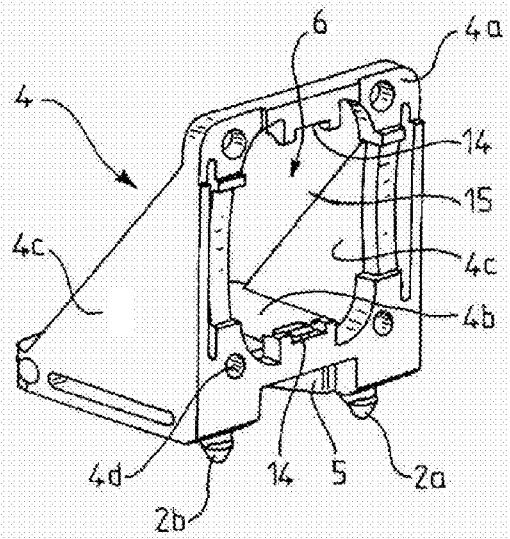
FIG. 2 shows a perspective view of the front face of the base of the device according to FIG. 1.

The wall 4*a* is more particularly illustrated in FIG. 2. As is shown in this figure, the wall 4*a* has an opening 15. This opening 15 has an approximately square-shaped configuration that is able to work with the shape of a connector or a connector support 31, such as a mono-module base; i.e., the connector or the connector support 31 is able to fit perfectly into the opening 15. Consequently, the opening 15 will have a standard configuration that is adapted to a type of connector.

At the level of the opening 15 and more particularly at the level of the upper end of the opening 15, the wall 4*a* also comprises an attachment clip 14. This attachment clip 14 is intended to be used as a stop for a ratchet 35 that is present on the connector support 31, as shown in FIG. 6. Between the lower end of the wall 4*a* and the lower end of the opening 15, there is a flange 9 that can work with a portion of the bolt 5 so as to form a second attachment clip that is also able to work with the ratchet 35 of the connector support 31.

In addition, the wall 4*a* can have four orifices 4*d* that are arranged at the corners of the opening 15 that is approximately square-shaped. These orifices 4*d* are used optionally to accommodate attachment means such as nails/screws/nuts/washers. However, these orifices are not essential to this invention.

Figure 3:
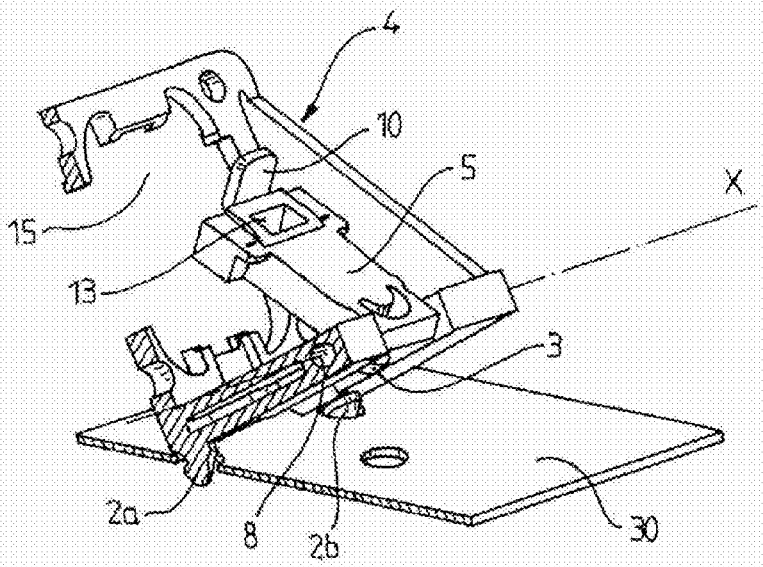
FIG. 3 shows a partial perspective view of the device of FIG. 1 when the base of said device tips out in a panel.

The wall 4*b* is illustrated in FIGS. 1 to 3. As mentioned above, one of the ends of this wall 4*b* is connected to one end of the wall 4*a* so as to form a right-angle dihedron. Two clamps, such as two hooks 2*a* and 2*b*, are arranged on this end of the wall 4*b*. By referring to FIG. 2, these two hooks 2*a* and 2*b* are positioned under the inside face of the wall 4*b*, i.e., the one that is not directed toward the housing 6. These two hooks 2*a* and 2*b* are arranged more particularly at the two corners of said end. These two hooks 2*a* and 2*b* are intended to be inserted into orifices 32*a*, 32*b* of a connector support panel 30 so as to form a first means of attachment of the attachment device 1 to the panel 30 (FIG. 1).

The wall 4*b* also comprises orifices 8 at the level of its other end, i.e., the one that is not connected to the wall 4*a*. These orifices 8 are arranged more particularly on the sides and in the thickness of the wall 4*b*. These orifices 8 are able to accommodate a shaft X, which is parallel to the shaft that runs through the hooks 2*a* and 2*b*.

In its center, the wall 4*b* also comprises a cavity 7, perpendicular to the shaft X (FIG. 1). This cavity 7 passes through the wall 4*b* so as to separate it into two parts. This receiving cavity 7 is able to accommodate a bolt 5.

In referring to FIG. 1, this bolt 5 has an approximately rectangular shape that is able to come, as mentioned above, into the cavity 7 of the wall 4*b*.

First of all, at one of its ends, this bolt 5 comprises two pivots that are inserted into the orifices 8 of the wall 4*b* so as to make the bolt 5 pivot around the shaft X. Thus, the bolt 5 is able to have various positions: an open position in which the bolt is outside of the cavity 7 and a closed or locked position in which the bolt 5 pivots around the shaft X and is inserted into the cavity 7 so as to block it.

Figure 4:
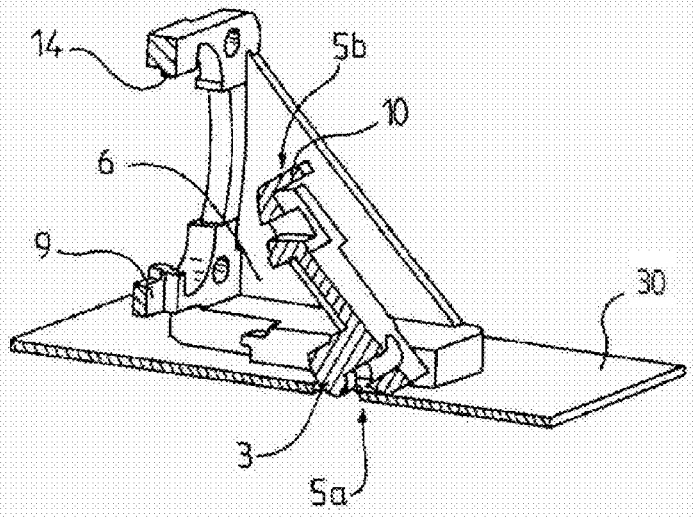
FIG. 4 shows a partial perspective view of the device of FIG. 1 when the bolt of said device tips out in the panel.
Figure 5:
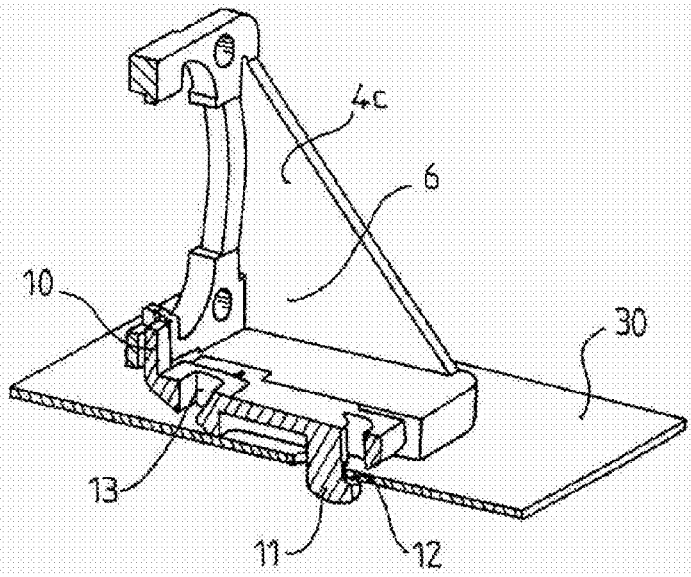
FIG. 5 shows a partial perspective view of the device of FIG. 1 when the bolt of said device bolts the latter.

In referring to FIGS. 4 and 5, the bolt 5 comprises an additional clamp of said device 1 at the level of the end where the shaft X runs. This clamp is also, as has been shown, a hook 3. This hook 3 comprises a hooked end fitting 11 that comprises a shoulder 12. This hook 3 is intended to be inserted into a third hole that is provided for this purpose in the panel 30 so as to form a second means for attaching the attachment device 1 to the panel 30.

At its other end, the bolt 5 also comprises a foot 10. This foot 10 is vertical relative to the essentially rectangular body of the bolt 5 and projects toward the housing 6. As indicated above, the foot 10 is able to work with and to fit with the flange 9 when it is inserted into the latter. This makes it possible to attach the bolt 5 to the base 4. In addition and as is shown in FIG. 6, this foot 10 and flange 9 unit forms an attachment clip for the ratchet 35 of the connector support 31. Consequently, the flange 9/foot 10 unit also constitutes a means of attaching the attachment device 1 to the connector support 31. In one variant embodiment, not shown, it is also possible to provide a lower attachment clip, identical to the upper attachment clip 14, which would be fitted into the ratchet 35 of the connector support 31. In this variant embodiment, the flange 9 and the foot 10 would juxtapose this lower attachment clip. Thus, the foot 10 would only be fitted into the flange 9 so as to attach only the bolt 5 into the base 4, while the lower attachment clip that is equivalent to clip 14 would be used to attach the attachment device 1 to the connector support 31. This variant embodiment makes it possible to disengage from the functions of various elements, namely the flange 9, the foot 10, the lower attachment clip . . .

The bolt 5 also comprises a hole 13. This hole 13, which is contiguous to the foot 10, passes all the way through the thickness of the bolt 5. For removing the attachment device 1, it is able to accommodate the shaft of a screwdriver, for example, so as to disengage, by levering, the bolt 5 from the base 4.

So as to produce the attachment device 1 as described above, the bolt 5 and the base 4 are molded in two different parts and therefore in two different operations. The bolt 5 and the base 4 are actually then connected by inserting the pivots (not shown) of the bolt 5 into the orifices 8 of the base 4.

In a variant embodiment, it is also possible to mold the base 4 and the bolt 5 into a single piece and therefore into a single operation. In this case, the bolt 5 pivots in the cavity 7 of the base 4, not via two pivots, but via a thin tab that acts as a hinge, which connects the end of the bolt 5 to the end of the base 4, where the shaft X is located.

This invention also relates to a connector attachment support 20 (FIG. 6) that comprises the attachment device 1 for a connector as described above, whose clamps 2*a*, 2*b* and 3 are able to be inserted into holes 32*a*, 32*b* and 33 that are provided for this purpose on the panel 30 of said attachment support 20.

Relative to the support of the prior art, the connector attachment support 20 has the advantage of not requiring complex cutting or precutting of the panel. As is shown in FIG. 1, it is enough to pierce three holes so as to install—in a removable manner—a connector or a connector support 31 via the attachment device 1. Consequently, each attachment device 1 and panel 30 are also reusable.

The operation of the attachment device 1 for a connector on a panel of a connector attachment support 20 will now be described in reference to FIGS. 3 to 6.

The attachment device 1 is first of all attached to the panel 30 by the two hooks 2*a* and 2*b*. For this purpose, the base 4 is slightly inclined relative to the panel 30 so that the hooks 2*a* and 2*b* engage in the holes 32*a* and 32*b* that are provided for this purpose. Then, the base 4 is tipped out on the panel 30 so that its wall 4*b* is entirely in contact with the panel 30.

During this time, the bolt 5 is in open position, as is shown in FIG. 4. This position makes it possible to insert the hook 3 into the orifice 33 that is provided for this purpose from panel 30. Then, the bolt 5 is tipped out and inserted into the cavity 7. The hooked end of the hook 3 comes to rest against the lower face of the panel 30, while the foot 10 of the bolt 5 comes against the flange 9 that is contiguous to the lower ratchet 14 that is present in the opening 15 of the wall 4*a*. The bolt 5 is now found in closed position (locked) as is shown in FIG. 5. Consequently, the attachment device 1 is attached to the panel 30 by the clamps 2*a*, 2*b* and 3.

Finally, the device 1 is locked by adding a connector or a connector support 31 on said device 1. In the standard manner, this connector support 31 has a collar 34 that can lock the bolt 5 in rotation, a ratchet 35 that can be fitted into the attachment clip 14 that is positioned at the upper end of the opening 15 and into the attachment clip that is formed by the flange 9 and the foot 10. Consequently, the connector prevents any rotation of the bolt 5 around its shaft X, and the bolt 5 remains in locked position.

To remove the attachment device 1, it will then be necessary to release the bolt 5. For this purpose, it is necessary to remove the connector or the connector support 31 so as to release the bolt 5. A simple screwdriver, for example, is sufficient to disconnect the attachment device 1 from the panel by inserting it into the hole 13 of the bolt 5 and by using it as a lever. Then, the bolt 5 is tipped out upward by pivoting around the shaft X, and its hook 3 is disengaged from the panel 30. Then, the hooks 2*a* and 2*b* are disengaged next. The attachment device 1 is consequently removed, without a specific tool, from the panel 30. The device 1 thus has the advantage of being easily removable.

The attachment device according to this invention has the advantages of no longer requiring a spring so as to attach a connector or a connector support to a panel. Consequently, it is possible with such a device to insert thereinto a shielded connector or a shielded connection. In addition, it can be made of a single piece and has the advantage of being modular. So as to attach various types of connectors to a panel, it is enough to adapt only the attachment device according to this invention that can also be easily attached or else removed from said panel.

Although the invention has been described in connection with a particular embodiment, it is quite obvious that it is in no way limited thereto and that it comprises all of the technical equivalents of the means that are described as well as their combinations if the latter are within the scope of the invention.

The invention claimed is:

1. An attachment device (1) for a connector, comprising at least two clamps (2*a*, 2*b*, 3) that can attach said attachment device (1) in a removable manner to a panel (30), and a base (4) that delimits a housing (6) that can accommodate a connector or a connector support (31), characterized in that said attachment device (1) comprises a bolt (5), whereby one of the clamps (3) is arranged on said bolt (5) and another of the clamps (2*a* or 2*b*) on said base (4), whereby said bolt (5) is able to pivot relative to the base (4) so as to bolt, via the clamp (3) of the bolt (5), said attachment device (1) to said panel (30), whereby said bolt (5) in addition is adjacent to the housing (6) such that when the connector or the connector support (31) is in the housing (6), the connector or the connector support (31) prevents the bolt (5) from pivoting.

2. The attachment device (1) according to claim 1, wherein the base (4) comprises a first wall (4*a*) that comprises a cavity (7) for accommodating the bolt (5), and a second wall (4*b*) that comprises an opening (15), the connector or the connector support (31) configured to fit through said opening into said housing (6).

3. The attachment device (1) according to claim 2, wherein the first wall (4*a*) is intended to be arranged parallel to the panel, whereby said second wall (4*b*) is perpendicular to the first wall (4*a*), such that the connector or the connector support (31) is inserted into the housing (6) that is parallel to the panel (30).

4. The attachment device (1) according to claim 2, wherein said first wall (4*a*) comprises two clamps (2*a* and 2*b*) on a face of said first wall intended to be in contact with said panel (30).

5. The attachment device (1) according to claim 1, wherein the bolt (5) comprises a foot (10).

6. The attachment device (1) according to claim 1, wherein said base (4) or said bolt (5) is molded in a single piece.

7. A connector attachment support (20) that comprises an attachment device (1) according to claim 1 and a panel (30) that is pierced by at least two holes (32*a*, 32*b*, 33), whereby said attachment device (1) is attached to the panel (30) by attachment means (2*a*, 2*b*, 3) of said attachment device that are inserted into said holes of the panel.

8. The attachment device (1) according to claim 3, wherein said first wall (4*a*) comprises two clamps (2*a* and 2*b*) on a face of said first wall intended to be in contact with said panel (30).

9. The attachment device (1) according to claim 2, wherein the bolt (5) comprises a foot (10) that is able to work with a flange (9) of the opening (15) so as to form an attachment clip for the connector or the connector support (31).

10. The attachment device (1) according to claim 3, wherein the bolt (5) comprises a foot (10) that is able to work with a flange (9) of the opening (15) so as to form an attachment clip for the connector or the connector support (31).

11. The attachment device (1) according to claim 4, wherein the bolt (5) comprises a foot (10) that is able to work with a flange (9) of the opening (15) so as to form an attachment clip for the connector or the connector support (31).

12. The attachment device (1) according to claim 2, wherein said base (4) or said bolt (5) is molded in a single piece.

13. The attachment device (1) according to claim 3, wherein said base (4) or said bolt (5) is molded in a single piece.

14. The attachment device (1) according to claim 4, wherein said base (4) or said bolt (5) is molded in a single piece.

15. The attachment device (1) according to claim 5, wherein said base (4) or said bolt (5) is molded in a single piece.

* * * * *